US005560309A

United States Patent [19]

Conley, Jr. et al.

[11] Patent Number: 5,560,309

[45] Date of Patent: *Oct. 1, 1996

[54] MATERIAL HANDLING SYSTEM

[75] Inventors: Ralph F. Conley, Jr.; Ricky J. Frye, both of Miamisburg; David L. Frey, Harveysburg, all of Ohio

[73] Assignee: MIM Industries, Inc., Miamisburg, Ohio

[ * ] Notice: The term of this patent shall not extend beyond the expiration date of Pat. No. 5,363,785.

[21] Appl. No.: 239,211

[22] Filed: May 6, 1994

Related U.S. Application Data

[63] Continuation-in-part of Ser. No. 934,715, Aug. 24, 1992, Pat. No. 5,363,785.

[51] Int. Cl.[6] ..... D05B 21/00

[52] U.S. Cl. ..... 112/470.18; 112/306; 112/475.07; 198/345.3; 414/222; 280/743.1

[58] Field of Search ..... 112/121.15, 303, 112/306, 311, 217.1, 217.2, 121.29, 475.12, 475.07, 470.06, 470.18, 475.14; 198/465.2, 346.1, 345.1, 345.3, 741; 414/791.1, 749, 222, 750; 280/743 R, 728 R; 104/242, 245, 48

[56] References Cited

U.S. PATENT DOCUMENTS

| | | | |
|---|---|---|---|
| 2,711,817 | 6/1955 | Hautau et al. | 198/210 |
| 3,075,651 | 1/1963 | Kaden | 214/1 |
| 3,670,675 | 6/1972 | Rovin et al. | 112/121.12 |
| 4,306,646 | 12/1981 | Magni | 198/341 |
| 4,422,393 | 12/1983 | Johnson et al. | 112/121.15 |
| 4,425,858 | 1/1984 | Hargett | 112/121.15 X |
| 4,444,140 | 4/1984 | Moyer | 112/475.12 X |
| 4,467,735 | 8/1984 | Sadeh | 112/470.14 |
| 4,587,910 | 5/1986 | Raines | 112/121.15 X |
| 4,602,578 | 7/1986 | Yokoe et al. | 112/121.15 |
| 4,660,280 | 4/1987 | Asai et al. | 29/759 |
| 4,694,766 | 9/1987 | Wickers et al. | 112/262.1 |
| 4,747,193 | 5/1988 | Hashidate et al. | 414/749 X |
| 4,862,815 | 9/1989 | Thurner et al. | 112/475.12 X |
| 4,883,006 | 11/1989 | Marii et al. | 112/121.12 |
| 4,996,931 | 3/1991 | Mall | 112/121.15 X R |
| 5,003,897 | 4/1991 | Yokoe et al. | 112/121.12 |
| 5,074,230 | 12/1991 | Morii et al. | 112/121.15 |
| 5,078,253 | 1/1992 | Vermeer et al. | 198/345.1 |
| 5,094,371 | 3/1992 | Takamura et al. | 223/75 X |
| 5,141,787 | 8/1992 | Yamamoto | 280/743 R X |
| 5,262,329 | 11/1993 | Drexel et al. | 112/245 |
| 5,363,785 | 11/1994 | Conley, Jr. | 112/121.15 |
| 5,456,194 | 10/1995 | Badillo | 112/68 X |
| 5,460,408 | 10/1995 | Conley, Jr. | 280/728.1 X |

FOREIGN PATENT DOCUMENTS

| | | | |
|---|---|---|---|
| 4063658 | 2/1992 | Japan | 198/346.1 |

*Primary Examiner*—Ismael Izaguirre
*Attorney, Agent, or Firm*—Jacox, Meckstroth & Jenkins

[57] ABSTRACT

A material handling system for forming an air bag in a plurality of workstations. The system includes a pallet for holding a workpiece in a predetermined orientation and a locator for locating the pallet in a plurality of workstations for performing different operations on the workpiece. The pallet is provided with structure for aligning the pallet in at least two workstations for performing different operations on the workpiece. The workstations preferably include a sewing station and a punch press station wherein the pallet is adapted to be accurately aligned in each of the stations for performance of respective sewing and hole cutting operations. The locator is operable for moving the pallet from a loading station to the sewing station and then to the punch press station. Further, the locator is operable to subsequently move the pallet to an unloading station or to a further workstation.

36 Claims, 8 Drawing Sheets

FIG-IIA
146
148
FIG-II
146
120
160
144
160
142
146
160
146
140
146
160
96
134
128
136
128
94
124
138
138
126
92
132
96'
94'

MATERIAL HANDLING SYSTEM

CROSS REFERENCE TO RELATED APPLICATION

This is a continuation-in-part of application Ser. No. 934,715, now issued as U.S. Pat. No. 5,363,785, filed Aug. 24, 1992.

BACKGROUND OF THE INVENTION

1. Field of the Invention

The present invention relates to a material handling system and, more particularly, to a material handling system operable for aligning a workpiece comprising panels for forming an air bag in a plurality of different workstations for performing different operations on the workpiece.

2. Related Prior Art

With the increasing use of air bags as an additional restraint system in automobiles, there is a corresponding need for manufacturing methods and apparatus which facilitate the construction of the air bags and thereby also reduce the time and cost of constructing the air bags. Conventional air bags are typically constructed from various panels which are combined into a single assembly forming the air bag.

In a known process for constructing air bags, a reinforcing panel, such as is used to reinforce the area of a hole for the air bag, is clamped in association with a main panel and the reinforcing and main panels are attached to each other, such as by a sewing operation, to form a panel structure. The panel structure is then unclamped for manual placement in a punch press where a hole is punched through the reinforcing and main panels. The prior art operation is labor intensive in that it requires manual placement of the workpiece formed by the panels in each of the workstations. Further, this operation is time consuming in that the panels have to be manually aligned in a predetermined orientation relative to the workstations before each of the different operations can be performed.

Accordingly, there is a need for a material handling system to facilitate handling workpieces, such as air bag panels, as the workpieces undergo various operations in different workstations. Specifically, there is a need for a material handling system whereby a workpiece may be easily transported between a plurality of workstations and wherein the workpiece is easily aligned within each workstation prior to the performance of a predetermined operation at that workstation.

SUMMARY OF THE INVENTION

The present invention provides a material handling system for moving a workpiece comprising air bag panels between a plurality of workstations wherein the workpiece is accurately aligned in the different workstations for the performance of different operations.

In one aspect of the invention, a material handling system is provided comprising a pallet for holding a workpiece in a predetermined orientation; a locator for locating the pallet in a plurality of workstations for performing different operations on the workpiece; and wherein the pallet includes means for aligning the pallet in at least two workstations for performing different operations on the workpiece.

In a further aspect of the invention, the workstations are provided with positioners for coupling to the means for aligning the pallet. The means for aligning the pallet may comprise means defining an aperture and means defining a slot on the pallet, and the positioners are adapted to engage within the aperture and the slot to thereby accurately position the workpiece relative to the workstation. In a further aspect of the invention, the material handling system is provided with at least two workstations wherein one of the workstations comprises a sewing station for sewing the workpiece and another of the workstations comprises a punch press station for punching a hole in the workpiece, and the locator is adapted to transfer the pallet between the sewing station and the punch press station.

In a further aspect of the invention, a material handling system is provided for forming an air bag in a plurality of workstations comprising a holder for holding panels of an air bag in association with each other; and a locator for locating the holder at predetermined orientations in a plurality of workstations for performing different operations on the panels.

In yet another aspect of the invention, the holder comprises a workpiece pallet including a base plate and a first pivot plate pivotally mounted to the base plate. A second pivot plate is pivotally mounted to the first pivot plate wherein the first pivot plate and second pivot plate each include an engaging surface for engaging and holding the panels in the predetermined orientations.

In another aspect of the invention, a method is provided for handling material in a system including a plurality of workstations for forming an air bag comprising the steps of:

(a) positioning air bag panels on a pallet; and (b) locating the pallet at predetermined orientations in a plurality of workstations for performing different operations on the panels.

In a further aspect of the method for handling material in a system, said step (b) comprises:

(b)(1) locating the pallet in a sewing station and sewing the panels;

(b)(2) the locator moving the pallet to a punch press station; and (b)(3) punching a hole in at least one of the panels.

Therefore, it is an object of the present invention to provide a material handling system for accurately placing a workpiece into different workstations for the performance of different operations on the workpiece.

It is a further object of the invention to provide such a material handling system wherein manual manipulation of the workpiece is minimized by providing a locator for moving the workpiece between different workstations.

Other objects and advantages of the invention will be apparent from the following description, the accompanying drawings, and the appended claims.

BRIEF DESCRIPTION OF THE DRAWINGS

FIG. 11A is a detailed view illustrating gripper members for use in holding material in the pallet.

DETAILED DESCRIPTION OF THE PREFERRED EMBODIMENT

The material handling system of the present invention is operable for moving and accurately aligning workpiece pallets in a plurality of workstations, and is particularly adapted to provide accurate alignment of the pallet and an associated workpiece within different workstations wherein at least two of the workstations perform different operations on the workpiece.

Figure 1:
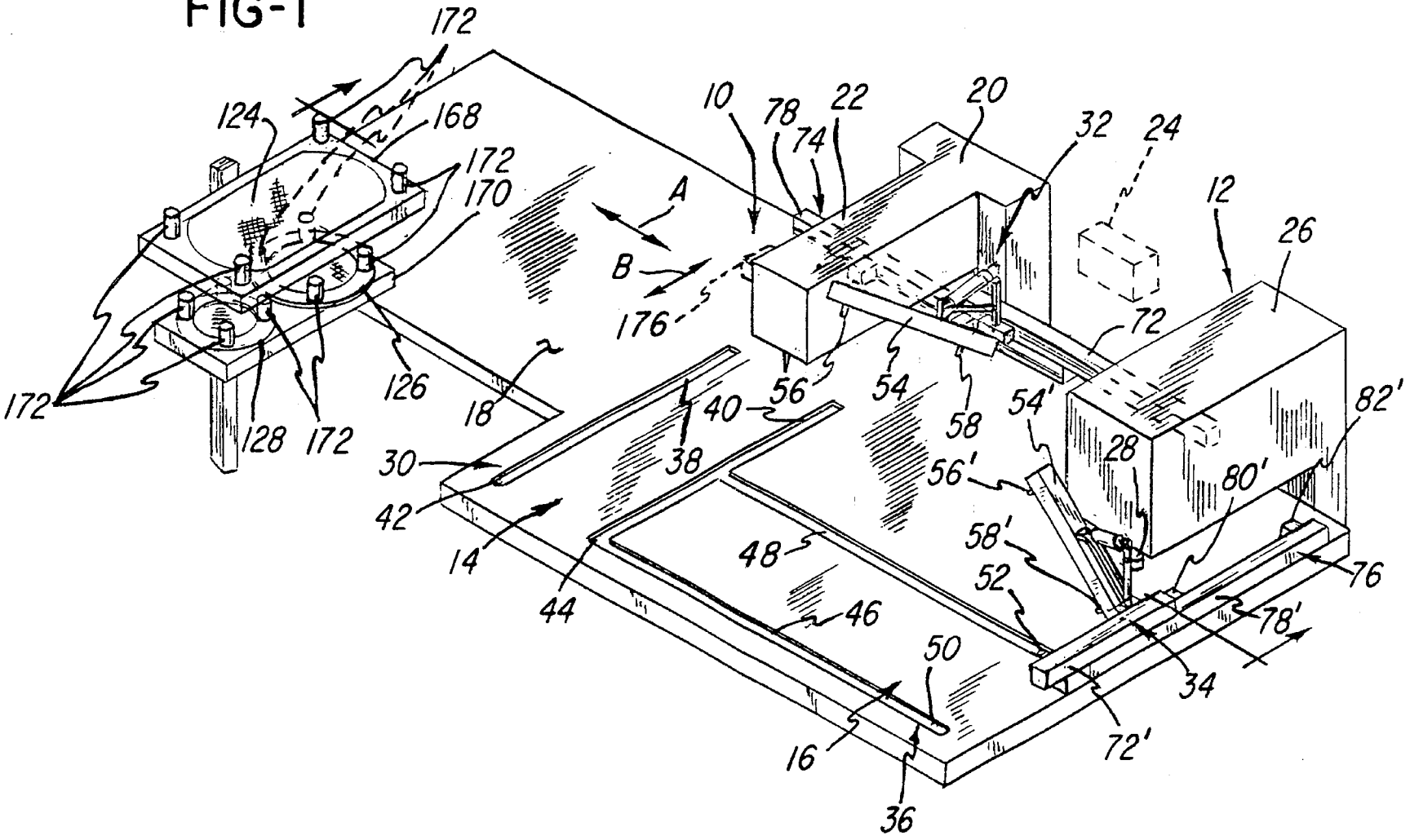
FIG. 1 is a perspective view of the material handling system of the present invention.

Referring initially to FIG. 1, the material handling system of the present invention includes at least a first workstation 10 and second workstation 12. In the embodiment shown, the first workstation 10 comprises a sewing station and the second workstation 12 comprises a punch press station. However, it should be understood that various different workstations may be provided, other than those shown, in order to perform different operations on a workpiece, as will be described further below.

A loading station 14 is located in front of the first workstation 10 and an unloading station 16 is located in front of the second workstation 12. Further, a common support surface 18 extends through the first and second workstations 10 and 12 and through the loading and unloading stations 14 and 16 such that the support surface 18 is adapted to support a workpiece pallet during movement throughout the different stations of the material handling system.

As noted above, the first workstation 10 may comprise a sewing station wherein the sewing station includes a sewing machine 20 such as a Brother model number BAS-340, manufactured by Brother Industries of Japan, having a movable sewing head 22 connected to a drive mechanism (not shown) for moving the sewing head 22 in two perpendicular directions, illustrated by arrows A and B. The movement of the sewing head 22 is preferably controlled by means of a programmable controller 24 to sew a predetermined pattern on a workpiece located under the sewing head 22.

Similarly, the second workstation 12 may include a punch press 26 having a vertically movable punch tool 28 supported for movement toward and away from the support surface 18 and controlled by the programmable controller 24. The punch tool 28 is preferably configured to punch or cut a hole in a workpiece located on the support surface 18, In the embodiment described, a press model number HIM-16 manufactured by Multipress of Columbus, Ohio is suitable for use in the present system.

The present system further includes a locator or locator system comprising transfer and orientation locators. Specifically, a first transfer locator 30 is provided for transferring pallets from the loading station 14 to the first workstation 10, a second transfer locator 32 is provided for moving workpiece pallets from the first workstation 10 to the second workstation 12, a third transfer locator 34 is provided for transferring workpiece pallets from the second workstation 12 to the unloading station 16 and a fourth transfer locator is provided for transferring workpiece pallets from the unloading station 16 to the loading station 14. The first transfer locator 30 preferably comprises a pair of slots 38, 40 formed in the support surface 18, and a pair of pins 42 and 44 which are adapted to extend and retract vertically through the slots 38 and 40, respectively. In addition, the pins 42 and 44 are mounted for longitudinal movement along the slots 38 and 40 toward and away from the first workstation 10. The transfer locator 30 is configured similar to the locator described in U.S. patent application No. 07/934,715 now issued as U.S. Pat. No. 5,363,785 and which, assigned to the assignee of the present invention and incorporated herein by reference.

The fourth transfer locator 36 also comprises a pair of longitudinally extending slots 46 and 48, and a pair of electromagnets 50 and 52 are mounted for movement through the slots 46 and 48. The electromagnets 50 and 52 may be mounted for movement using a drive mechanism similar to that used for the pins 42 and 44, as described in the above-noted U.S. application Ser. No. 07/934,715.

Figure 2:
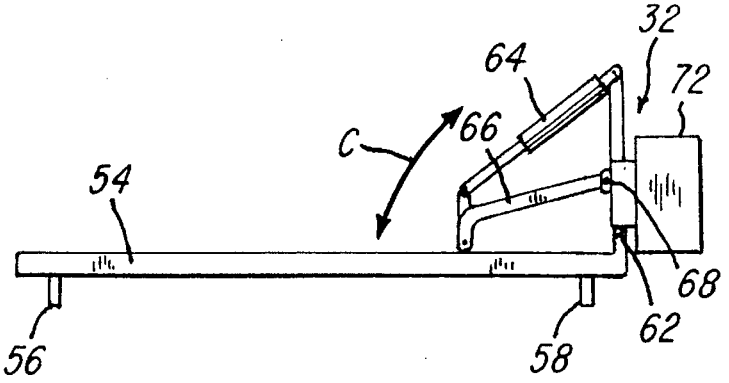
FIG. 2 is a side elevational view showing one of the transfer locators.
Figure 3:
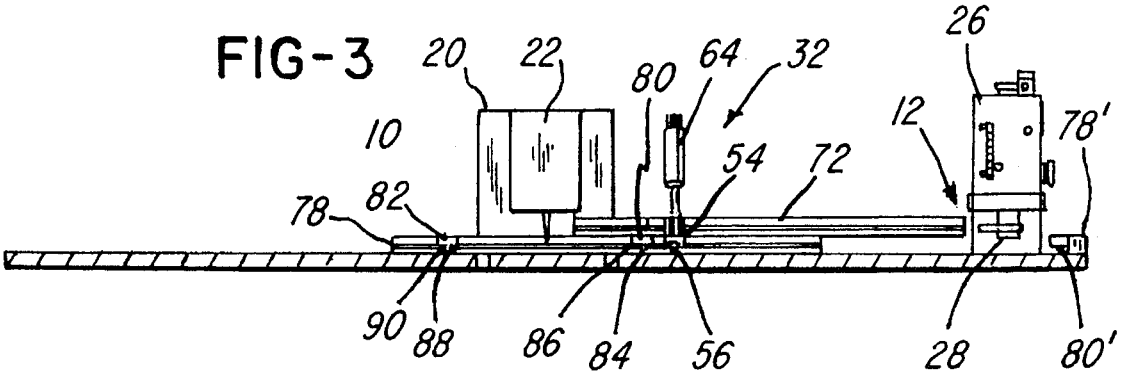
FIG. 3 is a front elevational view taken along line 3—3 in FIG. 1.

Referring to FIGS. 1–3, the second transfer locator 32 comprises a transfer bar 54 which carries a pair of downwardly extending pins 56 and 58 for engaging with a pallet, as will be described further below. The transfer bar 54 is mounted to a transfer block 60 via a link 61 and pivot points 62 and 63 whereby the transfer bar 54 may be pivotably moved upwardly and downwardly as illustrated by arrow C. The transfer arm 54 is actuated for movement by a cylinder 64 supported on the block 60 wherein a rod of the cylinder 64 is connected to an upper linkage 66 which is pivotably connected to the block 60 at pivot point 68 and to the arm 54 at pivot point 70. In addition, the transfer block 60 is supported for movement along a rail 72 and is actuated for movement along the rail 72 by means of a linear actuator which may comprise a hydraulic or pneumatic cylinder actuator or an equivalent driver.

The third transfer locator 34 is substantially the same as the second transfer locator 32, and similar elements on the third transfer locator 34 are labeled with the same numerals primed.

Referring to FIGS. 1 and 3, the locator or locator system further includes a first orientation locator 74 located in the first workstation 10, and a second orientation locator 76 located in the second workstation 12. The first orientation locator 74 includes a rail 78 supporting first and second orientation positioners 80 and 82, respectively. The orientation positioner 80 includes a cylindrical pin 84 actuated by a solenoid actuator 86, and the orientation positioner 82 includes a slide block 88 which is supported and actuated for vertical movement by a solenoid actuator 90.

Figure 10A:
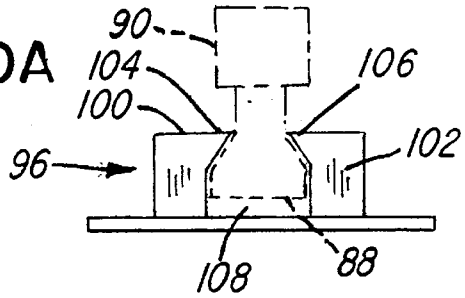
FIG. 10A is a side elevational view taken along line 10A—10A in FIG. 10.
Figure 10:
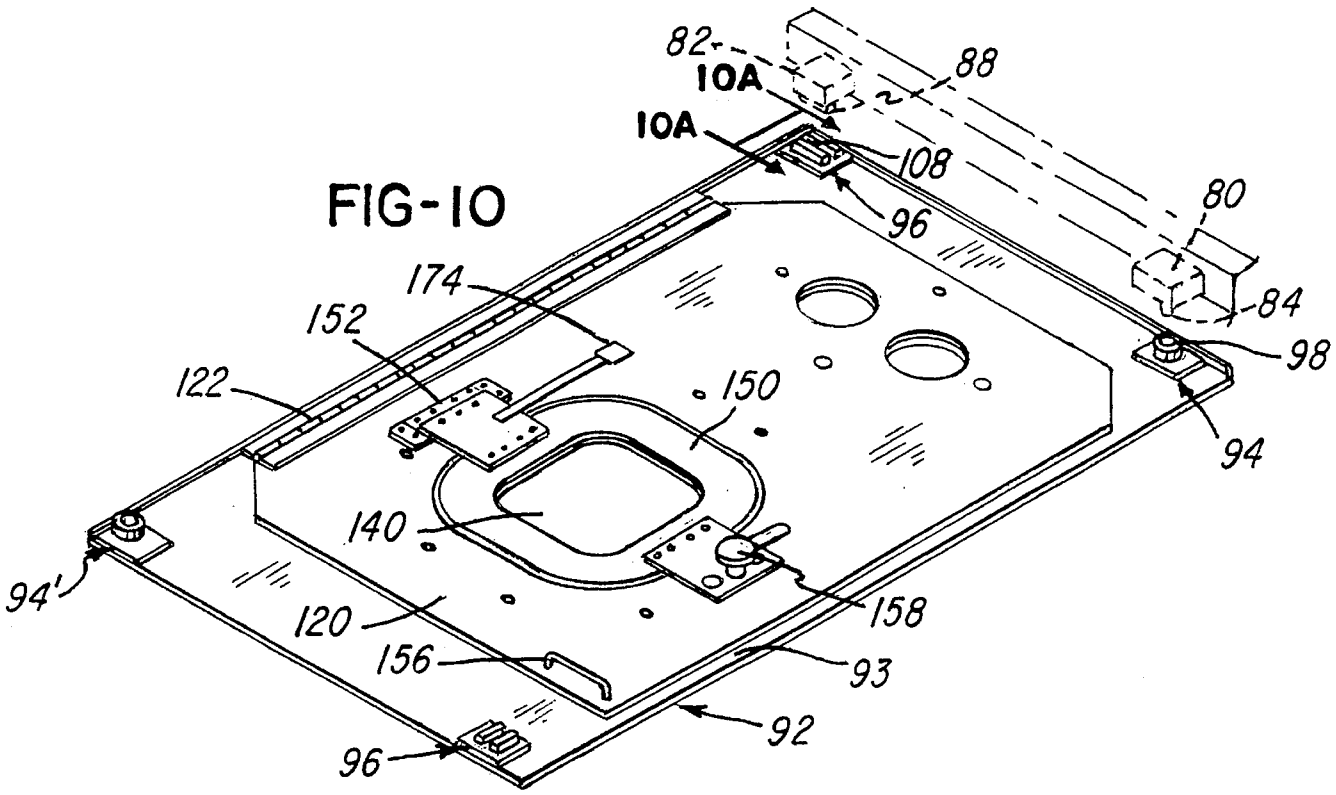
FIG. 10 is a perspective view of a pallet for carrying a workpiece in the system.

Referring to FIG. 10, a pallet 92 for use with the present system is illustrated and comprises means for aligning the pallet, 92 including a first set of couplers including a cylindrical first coupler 94 and a second coupler 96 having a generally rectangular configuration. The first coupler 94 includes a cylindrical aperture 98 for receiving the pin 84 when it is actuated by the solenoid 86 to move downwardly, and the second coupler 96 includes a pair of upstanding members 100 and 102 extending from an upper surface of a base plate 93 for the pallet 92. Referring to FIG. 10A, the upstanding members 100 and 102 each include respective upper portions 104 and 106 extending toward each other whereby a slot 108 having a restricted upper end is defined for receiving the positioner block 88, and the block 88 is formed with a complementing shape for reception within the slot 108. It should be noted that in order for the block 88 to be received within the slot 108, the block 88 must be actuated by the locator 74 to move sideways relative to the upstanding members 100 and 102 while the block 88 is extended downwardly by the solenoid 90. The orientation positioners 80 and 82 are actuated for simultaneous movement along the rail 78 to precisely orient a pallet 92 within the first workstation 10. In addition, it should be noted that the rail 78 is located below the rail 72 such that the orientation positioners 80 and 82 may pass below the transfer arm 54 during an operation in which the pallet is transferred from the orientation locator 74 to the transfer locator 32, as will be described in greater detail below.

The second orientation locator 76 is formed with substantially the same structure as the first orientation locator 74 and elements in the second orientation locator 76 corresponding to elements in the first orientation locator are labeled with the same reference numerals primed.

Referring to FIG. 10, it should be noted that the pallet 92 is provided with a second pair of couplers identical to the first pair of couplers, and the elements of the second pair of couplers corresponding to elements of the first pair of couplers are identified with the same reference numeral primed. Further, it should be noted that in the second workstation 12 the second orientation locator 82' includes a solenoid actuated cylindrical pin for engaging within the first coupler 94 of the first pair of couplers and the first orientation positioner 80' includes a solenoid actuated block for engaging with the coupler 96' of the second pair of couplers whereby the pallet will be accurately located within the second workstation 12.

Figure 4:
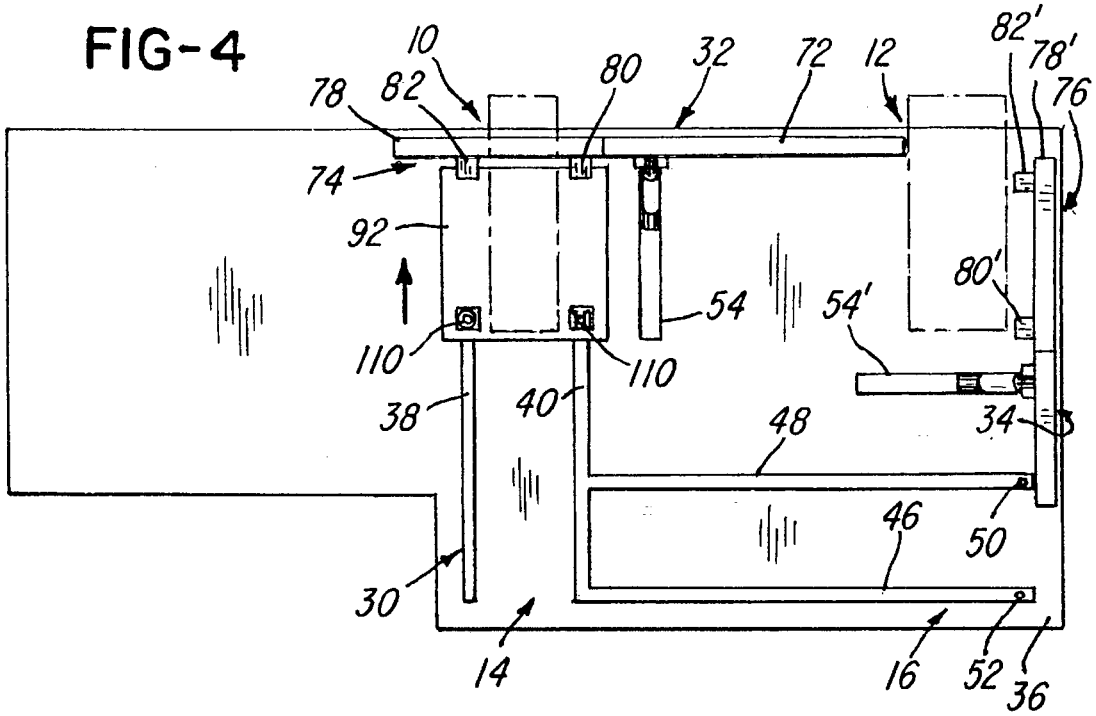
FIG. 4 is a diagrammatic plan view showing transfer of a pallet from the loading station to the first workstation.
Figure 5:
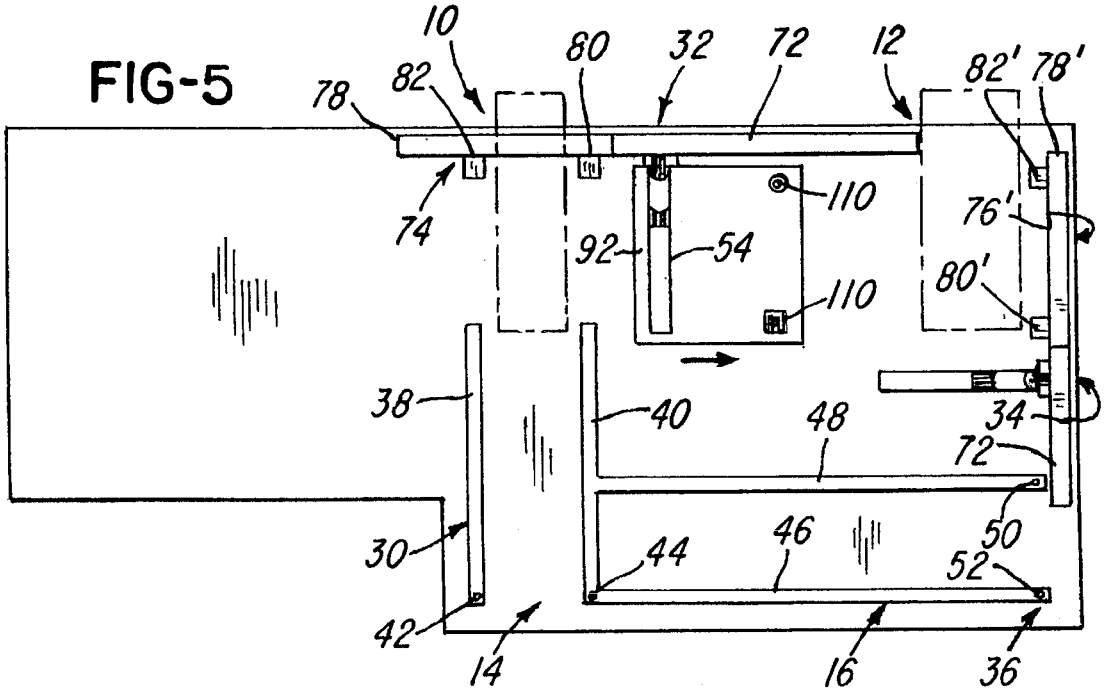
FIG. 5 is a diagrammatic plan view showing transfer of a pallet from the first workstation to the second workstation.

Although the present system is particularly designed to be used with a plurality of pallets processed through the system simultaneously, the operation of the locator or locator system will initially be described with reference to passage of a single pallet 92 through the system. Referring to FIG. 4, the pallet 92 is illustrated being transferred from the loading station 14 to the first workstation 10. It should be noted that each of the couplers 94, 96 and 94', 96' are provided with a through hole 110 and the pins 42 and 44 extend upwardly through the slots 38 and 40 to engage within the holes 110 of the second pair of couplers 94' and 96'. The first transfer locator 30 moves the pallet 92 to a location within the first workstation 10 where the first pair of couplers 94 and 96 are located underneath the orientation positioners 80 and 82. The pins 42 and 44 of the first transfer locator are then retracted from the holes 110 in the pallet 92 and the controller 24 causes the pin 84 and block 88 to be actuated to engage respective couplers 94 and 96 to thereby accurately orient the pallet 92 within the first workstation 110. After performing an operation on a workpiece supported on the pallet 92, for example a sewing operation, the controller 24 energizes the first orientation locator 74 to move the pallet 92 toward the second workstation 12 a limited distance to align the couplers 94 and 96' underneath the transfer bar 54 of the second transfer locator 32. The orientation positioners 80 and 82 are then moved back to the first workstation 10 in preparation to receive another pallet, and controller 24 energizes the cylinder 64 to pivot the transfer arm 54 downwardly to cause the pins 56 and 58 to engage within the through holes 110 formed in the couplers 94 and 96', as illustrated in FIG. 5.

Figure 6:
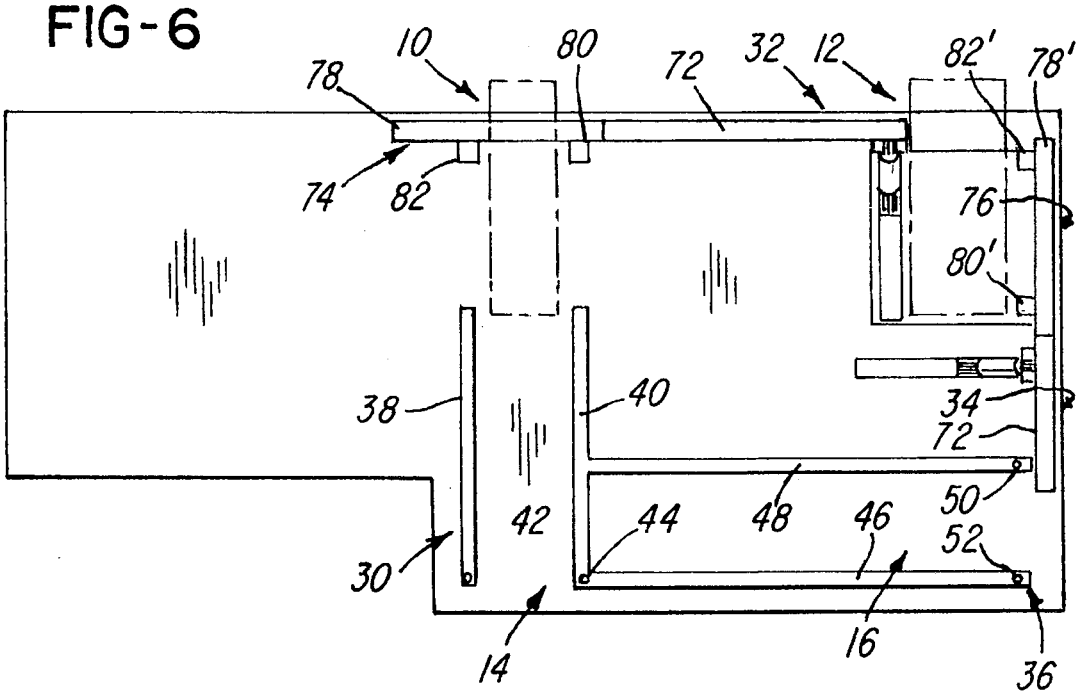
FIG. 6 is a diagrammatic plan view showing transfer of a pallet from the first transfer locator to the second orientation locators.
Figure 7:
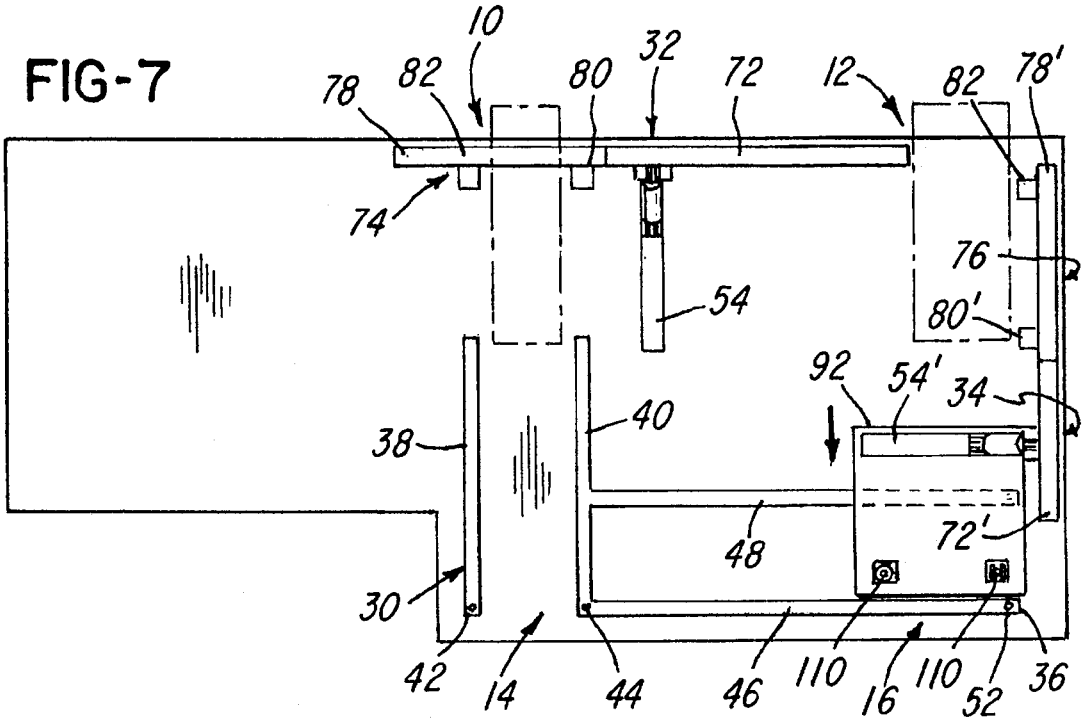
FIG. 7 is a diagrammatic plan view showing transfer of a pallet from the second workstation to the unloading station.

The controller 24 energizes the second transfer locator to move the transfer arm 54 along the rail 72 whereby the pallet 92 is moved into the second workstation 12 with the couplers 94 and 96' positioned underneath the orientation locators 82' and 80', as shown in FIG. 6. The transfer arm 54 is then pivoted upwardly to disengage from the pallet 92 and to move back toward the first workstation 10 in preparation for another transfer operation. In the second station 12, a second operation is performed on the workpiece held by the pallet 92, for example a hole cutting or punching operation. After the operation in the second workstation 12 is completed, the controller 24 energizes the second orientation locator 76 to move the pallet 92 into alignment with the transfer arm 54 of the third transfer locator 34, and the arm 54' is pivoted downwardly to cause the pins 56' and 58' to engage within the holes 110 defined in the first pair of couplers 94 and 96. The third transfer locator 34 moves the pallet 92 into the unloading station 16, as illustrated in FIG. 7, where the workpiece may be unloaded from the pallet 92 by a worker at this station.

Figure 8:
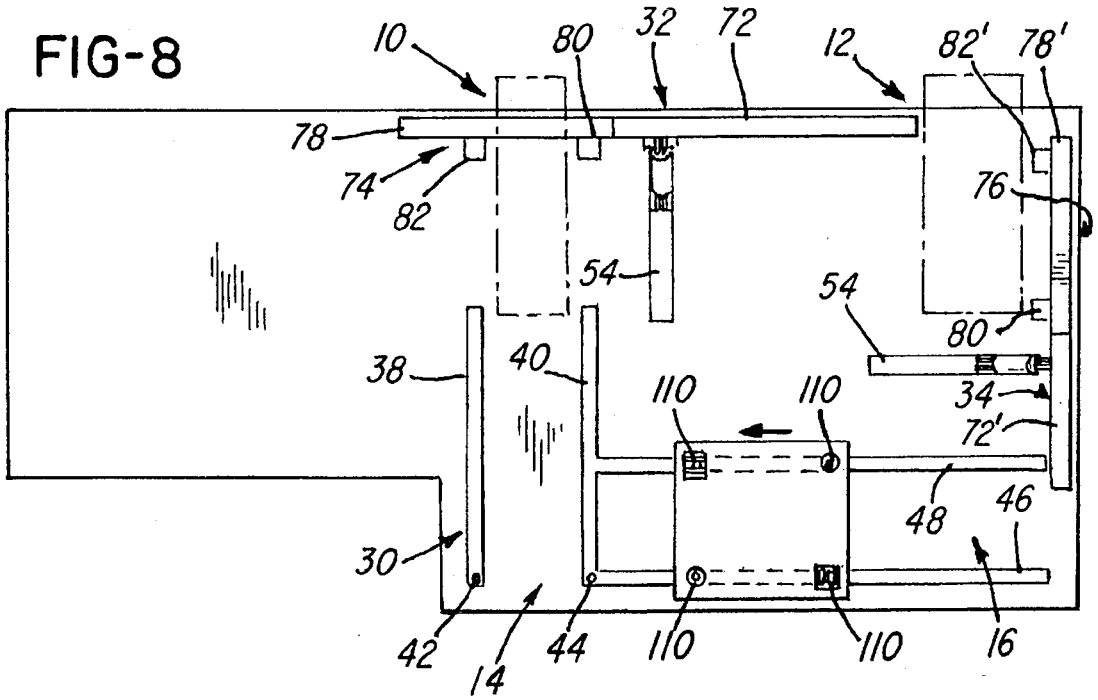
FIG. 8 is a diagrammatic plan view showing transfer of a pallet from the unloading station to the loading station.

Subsequently, the electromagnets 50 and 52 of the fourth transfer locator 36 are energized to magnetically couple with the pallet 92, which is preferably formed of a magnetic material. With the fourth transfer locator 36 thus coupled to the pallet 92, the electromagnets 50 and 52 are actuated to move along the slots 46 and 48 toward the loading station 14 where the pallet 92 may be loaded with workpiece forming materials, as illustrated in FIG. 8.

Figure 9:
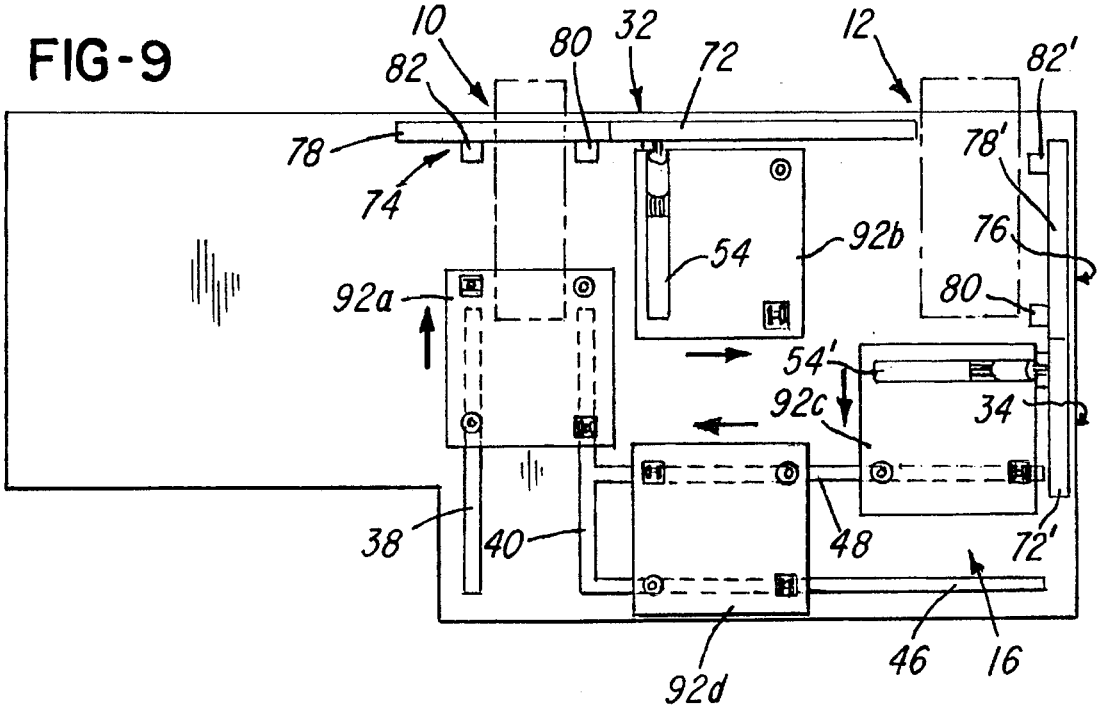
FIG. 9 is a diagrammatic plan view showing simultaneous transfer of pallets through the material handling system.

Referring to FIG. 9, the operation of the material handling system of the present invention is illustrated wherein four pallets 92*a–d* are shown being simultaneously transferred between the different stations of the system. It should be apparent that by providing a locator or locator system wherein orientation locators are provided associated with each of the workstations 10 and 12, and transfer locators are provided between each of the stations of the system, it is possible to efficiently transfer a plurality of pallets through the system simultaneously while ensuring that the pallets will be accurately oriented in each of the workstations for the performance of a desired operation. Further, the locator or locator system of the present material handling system ensures that the plurality of pallets may move through the system without the need for an operator to manipulate or align the pallets in the various workstations.

Figure 11:
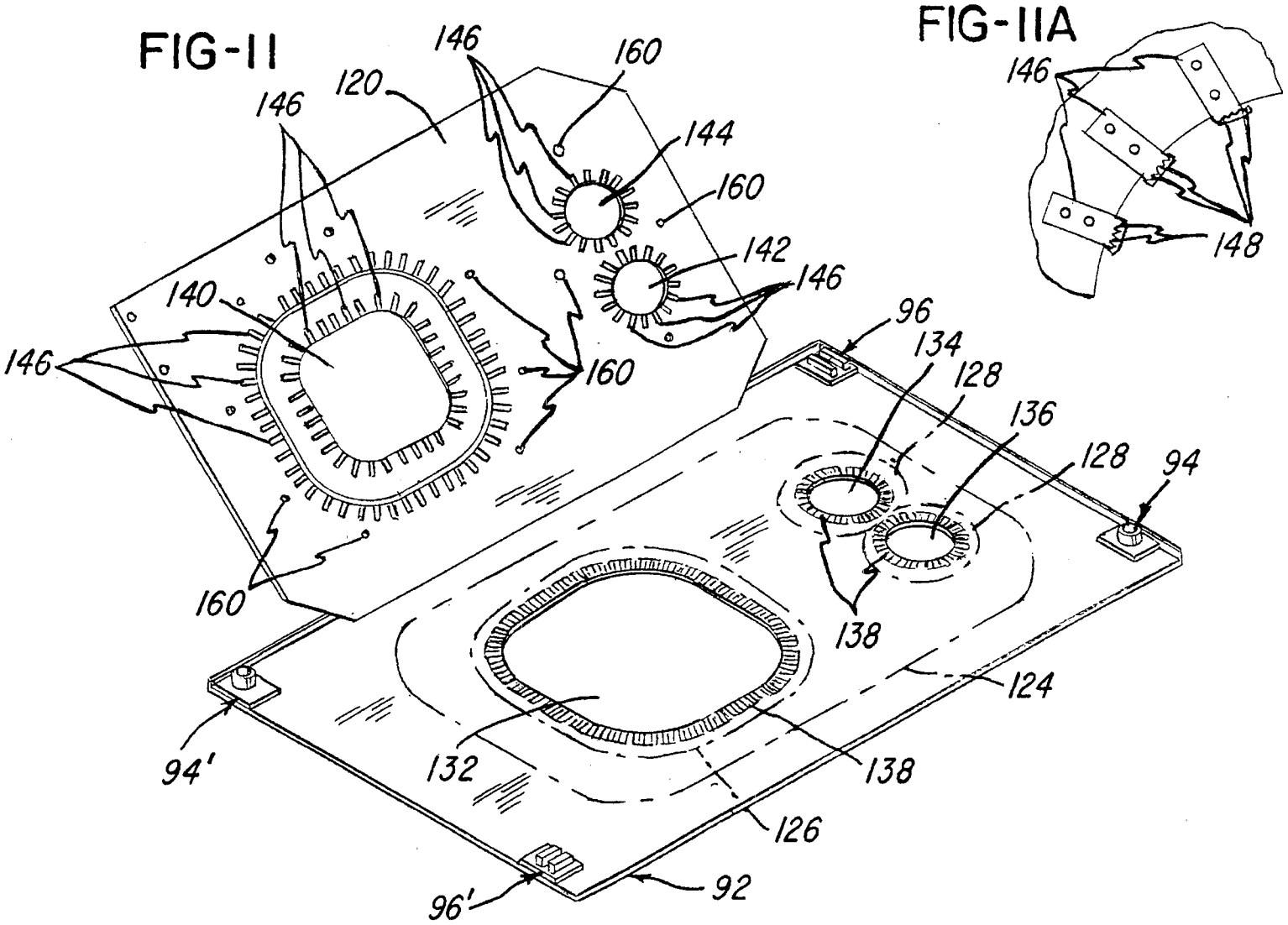
FIG. 11 is a perspective view of the pallet with a first plate located in a raised position.
Figure 12:
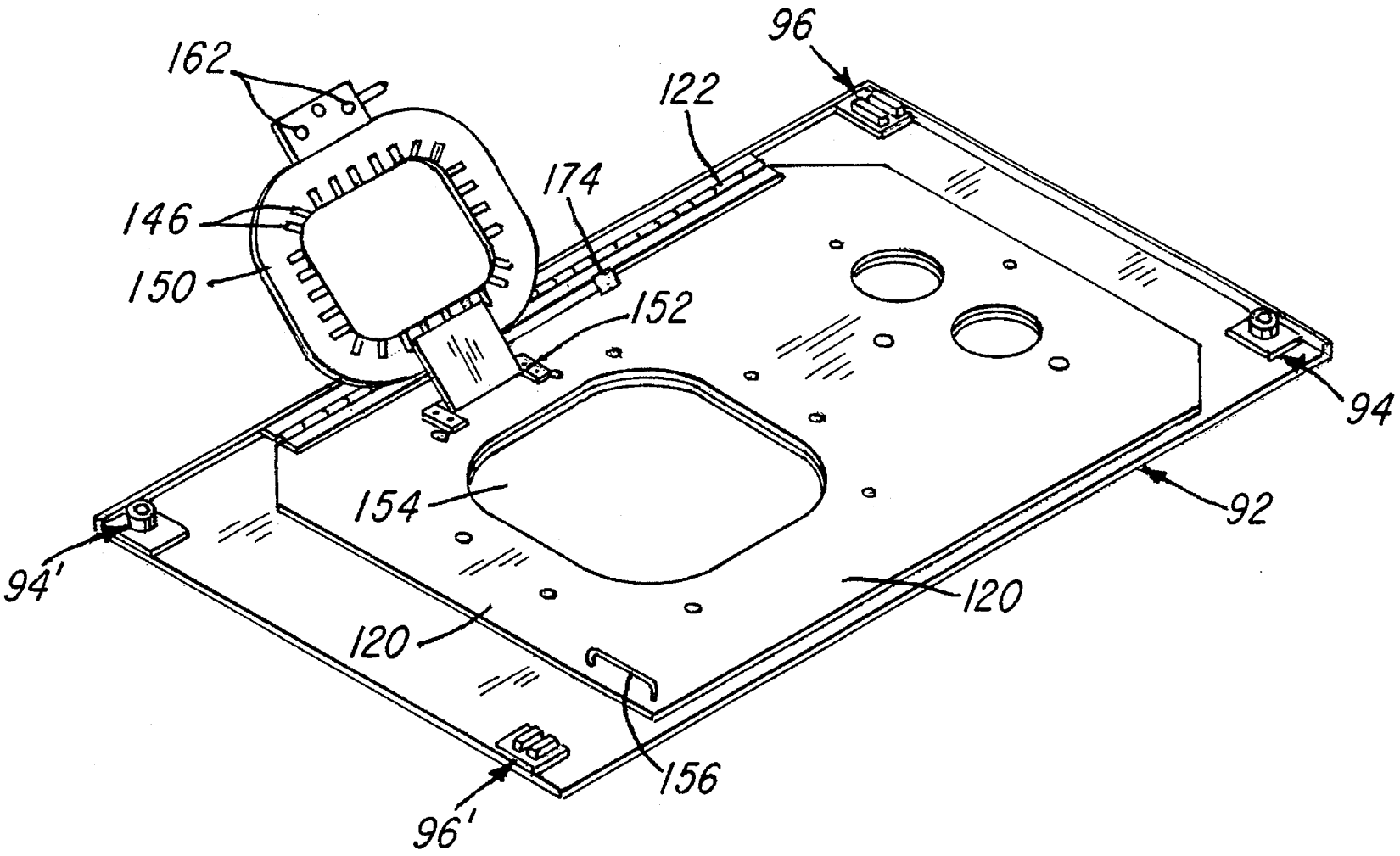
FIG. 12 is a perspective view of the pallet with a second plate located in a raised position.

Referring to FIGS. 10–12, the pallet 92 for the present material handling system is particularly adapted to hold panels for forming an air bag. Specifically, a first pivot plate 120 is attached to the base plate 93 at a hinge 122 whereby the first pivot plate 120 is adapted to be pivoted to the open position shown in FIG. 11. With the first pivot plate 120 in the open position, a main panel of the air bag, depicted in phantom lines as element 124, may be placed on the base plate 93. In addition, reinforcing panels, depicted in phantom lines as elements 126 and 128 may be placed on the main panel 124 at locations defined by apertures 132, 134 and 136 formed in the base plate 93. It should be noted that a friction enhancing material 138, such as emery cloth or other rough or non-slip material, is preferably attached to the base plate 93 in locations surrounding the apertures 132, 134 and 136.

The first pivot plate 120 is provided with apertures 140, 142 and 144 for aligning with the apertures 132, 134 and 136, respectively, when the pivot plate 120 is pivoted down to a closed position. In addition, a plurality of gripper members 146 comprising metal tangs having gripper teeth 148 (see FIG. 11A) are located around the periphery of the apertures 140, 142 and 144.

Referring to FIG. 10, it should be noted that the aperture 140 is defined within a second pivot plate 150 which is mounted to the first pivot plate 120 at a hinge connection 152. As seen in FIG. 12 the second pivot plate 150 is adapted to pivot away from the first pivot plate 120 to expose an enlarged aperture 154, and a plurality of gripper members 146 are located around the periphery of the enlarged aperture 154 (FIG. 11). The gripper members 146 cooperate with the friction enhancing material 138 to hold the air bag panels 124, 126 and 128 in their desired locations relative to the pallet 92 during the sewing and hole punching operations whereby the material for forming the air bag is held taught within the pallet 92 during the performance of the different operations on the material.

As seen in FIG. 10 the first pivot plate 120 is provided with a handle 156 to facilitate an operator lifting the first pivot plate 120 to its open position. Similarly, the second pivot plate 150 is provided with a handle 158 to facilitate opening this plate to its open position, as seen in FIG. 12 Further, the first pivot plate 120 is provided with a plurality of magnets 160 (FIG. 11) for maintaining the first pivot plate 120 in its lowered position lying across the air bag panels 124, 126 and 128. It should be noted that the magnets 160 are sufficiently strong to maintain the first pivot plate 120 in firm engagement against the workpiece defined by the air bag panels. Similarly, as seen in FIG. 12, the second pivot plate 150 is provided with magnets 162 for holding the second pivot plate 150 in its closed position against the first pivot plate 120.

The apertures defined in the pallet 92 permit the panels 124, 126 and 128 for forming the air bag to be sewn and punched at the different workstations 10 and 12. Further, it should be noted that the material forming the air bag is held tightly in a predetermined position within the pallet 92 throughout the operations performed by the present material handling system.

Referring again to FIGS. 1 and 4–9, an operation for forming an air bag in the present material handling system is performed by the system first locating a pallet 92 in the loading station 14 and an operator opening the first pivot plate 120 to receive the panels 124, 126 and 128. The loading station 14 may be provided with a tiered panel support 156 having a first tier 168 for supporting the main panel 124 and a second tier 170 for supporting the reinforcing panels 126 and 128. In addition, each of the tiers 168 and 170 include upstanding pedestal members 172 for engaging the perimeter of the panels 124, 126 and 128 to thereby maintain the panels in a desired location on the tiers 168 and 170.

After the panels 124, 126 and 128 have been placed on the base plate 93 of the pallet 92, the first pivot plate 120 is pivoted to a closed position and the programmable controller 24 actuates the first transfer locator 30 to move the pallet 92 to the first workstation 10 as depicted in FIG. 1, where the positioners 80 and 82 are actuated by the control let 24 into engagement with the couplers 94 and 96. The panels may then be sewn together by the sewing head 22 under control of the programmable controller 24. It should be noted that the second pivot plate 150 is provided with an indicator member 174 (FIG. 10) which is sensed by an optical sensor 176 located at the first workstation 10. Sensing of the indicator member 174 is used to indicate to the programmable controller 24 the position of the second pivot plate 150. For example, when the second pivot plate 150 and indicator member 174 are pivoted up, the optical sensor 176 will sense the absence of the indicator member 174. The programmable controller 24 may use this information to either prevent the operation from continuing if the second pivot plate 150 is not in a desired position or to cause the sewing head 22 to perform a desired sewing operation depending on the position of the second pivot plate 150.

When the sewing operation has been completed, the second transfer locator 32 will be actuated by the programmable controller 24 to move the pallet 92 to the second workstation 12 where the pallet 92 is moved into position for engagement with the positioners 80' and 82' as depicted in FIGS. 5 and 6. In the second workstation 12, holes may be punched through the panels 124, 126 and 128 at the locations of the apertures in the pallet 92. After the punch press operation, the controller 24 actuates the orientation locator 76 to move the pallet into alignment with the third transfer locator 34, and the controller subsequently actuates the third transfer locator 34 to move the pallet 92 to the unloading station 16. At the unloading station 16 another operator may unload the pallet 92, and the controller 24 then actuates the fourth transfer locator 36 to move the pallet from the unloading station 16 to the loading station 14 for another airbag assembly operation.

As noted above, the present material handling system is adapted to operate on a plurality of pallets 92 at the same time. For example, a pallet may be located at each of the stations 10, 12, 14 and 16 simultaneously where the respective operations of each of the stations may be performed, and subsequently the pallets may be simultaneously moved to the next station for a further operation.

It should be understood that various modifications may be made to the present material handling system within the scope of the invention. For example, different workstations may be provided other than sewing and punch stations. Further, the system may be expanded to include additional workstations wherein additional transfer locators similar to the third and fourth transfer locators 32 and 34 may be provided to transfer the pallet to the additional workstations.

Also, the various operations performed on the workpieces may also be altered. For example, alternative means for attaching the panels together, such as an ultrasonic welding apparatus, may be provided as an alternative to the sewing head. Similarly, alternative cutting means may be provided as a substitute for or in addition to the punch press described above.

Thus, various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

We claim:

1. A material handling system comprising:

a plurality of pallets for holding workpieces in a predetermined orientation;

a locator for locating said pallets in a plurality of workstations for performing different operations on said workpieces; and wherein said pallets include means for aligning said pallets in at least two workstations for performing different operations on said workpieces, and further including positioners associated with said at least two workstations for coupling with said means for aligning said pallets.

2. The material handling system as recited in claim 1 wherein said locator is operable for moving said pallets between said at least two workstations.

3. The material handling system as recited in claim 1 wherein said means for aligning said pallets includes means defining an aperture and means defining a slot and said positioners engage within said aperture.

4. The material handling system as recited in claim 1 wherein at least one of said at least two workstations comprises a sewing station for sewing said workpieces.

5. The material handling system as recited in claim 1 wherein at least one of said at least two workstations comprises a punch press station for punching a hole in said workpieces.

6. The material handling system as recited in claim 1 wherein said at least two workstations comprise:

a sewing station for sewing said workpieces; and a punch press station for punching a hole in said workpieces;

wherein said locator transfers said pallets between said sewing station and said punch press station.

7. The material handling system as recited in claim 6 including positioners associated with said workstations for coupling to said means for aligning said pallets whereby said pallets are aligned at predetermined locations in said workstations.

8. The material handling system as recited in claim 1 wherein said locator is operable for locating a pallet at each of said at least two workstations at substantially the same time.

9. The material handling system as recited in claim 1 wherein said locator includes a plurality of transfer locators for simultaneously transferring said plurality of pallets through said system.

10. A material handling system comprising:

a plurality of pallets for holding workpieces in a predetermined orientation;

a locator for locating said pallets in a plurality of workstations for performing different operations on said workpieces; and wherein said pallets include means for aligning said pallets in at least two workstations for performing different operations on said workpieces, and further including a loading station, a first transfer locator for moving a pallet from said loading station to a first one of said workstations and a second transfer locator for moving the pallet from said first one of said workstations to another one of said workstations, wherein said first transfer locator is different from said second transfer locator.

11. The material handling system as recited in claim 10 wherein said first and second transfer locators are adapted to simultaneously engage the pallet.

12. A material handling system for forming an air bag in a plurality of workstations comprising:

a holder for holding panels of an air bag in association with each other; and a locator for locating said holder at predetermined orientations in a plurality of workstations for performing different operations on said panels, wherein said holder comprises a workpiece pallet including a base plate and at least one pivot plate pivotally mounted to said base plate.

13. The material handling system as recited in claim 12 wherein said locator is operable for locating said holder in a sewing station for sewing said panels.

14. The material handling system as recited in claim 12 wherein said locator is operable for locating said holder in a workstation for cutting at least one of said panels.

15. The material handling system as recited in claim 14 wherein said workstation for cutting at least one of said panels comprises a punch press station.

16. The material handling system as recited in claim 12 wherein said plurality of said workstations comprises at least a sewing station and a punch press station.

17. The material handling system as recited in claim 16 wherein said locator is operable for moving said holder between said sewing station and said punch press station.

18. The material handling system as recited in claim 12 wherein said workstations include positioners for coupling to said holder.

19. The material handling system as recited in claim 12 including a loading station for providing said panels to said holder wherein said locator is operable for moving said holder from said loading station to said workstations.

20. The material handling system as recited in claim 12 wherein said locator includes a plurality of transfer locators for simultaneously transferring a plurality of holders through said system.

21. The material handling system as recited in claim 12 wherein said pallet further includes a second pivot plate pivotally mounted to said at least one pivot plate wherein said at least one pivot plate and said second pivot plate each include an engaging surface for engaging and holding said panels in said predetermined orientations.

22. The material handling system as recited in claim 21 wherein said at least one pivot plate is operable for holding a main panel of said air bag on said pallet and said second pivot plate is operable for holding a reinforcing panel of said air bag in association with said main panel.

23. A material handling system for forming an air bag in a plurality of workstations comprising:

a holder for holding panels of an air bag in association with each other; and a locator for locating said holder at predetermined orientations in a plurality of workstations for performing different operations on said panels, wherein said holder is a pallet including means for aligning said pallet in at least two workstations, and wherein said means for aligning said pallet comprises means for defining an aperture and means defining a slot on said pallet.

24. A material handling system for forming an air bag in a plurality of workstations comprising:

a holder for holding panels of an air bag in association with each other; and a locator for locating said holder at predetermined orientations in a plurality of workstations for performing different operations on said panels, further including a loading station, a first transfer locator for moving said holder from said loading station to a first one of said workstations and a second transfer locator for moving said holder from said first one of said workstations to another one of said workstations, wherein said first transfer locator is different from said second transfer locator.

25. The material handling system as recited in claim 24 wherein said first and second transfer locators are adapted to simultaneously engage the holder.

26. A method for handling material in a system including a plurality of workstations comprising the steps of:

(a) positioning a workpiece on a pallet;

(b) locating said pallet at predetermined orientations in a plurality of workstations for performing different operations on said workpiece, wherein said locating step includes the step of moving said pallet with a transfer locator into each of said workstations, said transfer locator operating to align said pallet with an orientation locator in each of said workstations.

27. The method as recited in claim 26 including a plurality of pallets and said step (b) comprises locating each of said pallets at a station within said system.

28. The method as recited in claim 26 wherein said step (b) comprises simultaneously moving a plurality of pallets through said system.

29. The method as recited in claim 28 including a plurality of transfer locators for engaging said plurality of pallets, said transfer locators operating to transfer pallets between adjacent stations in said system.

30. The method as recited in claim 29 wherein at least one of said transfer locators is adapted to move a pallet from a first workstation to a second workstation and another said transfer locator is adapted to substantially simultaneously move another pallet into said first workstation.

31. A method for handling material in a system including a plurality of workstations for forming an air bag comprising the steps of:

(a) positioning air bag panels on a pallet; and (b) locating said pallet at predetermined orientations in a plurality of workstations for performing different operations on said panels, wherein said locating step includes the step of moving said pallet with a transfer locator into each of said workstations, said transfer locator operating to align said pallet with an orientation locator in each of said workstations.

32. The method as recited in claim 31 wherein said step (b) comprises locating said pallet in a sewing station and sewing said panels.

33. The method as recited in claim 31 wherein said step (b) comprises locating said pallet in a punch press station and punching a hole in at least one of said panels.

34. The method as recited in claim 31 wherein said step (b) comprises:

(b)(1) locating said pallet in a sewing station and sewing said panels;

(b)(2) said locator moving said pallet to a punch press station; and (b)(3) punching a hole in at least one of said panels.

35. The method as recited in claim 31 wherein said step (a) is performed at a locating stations and said step (b) comprises said locator moving said pallet from said loading station to a first workstation.

36. The method as recited in claim 31 wherein said step (a) comprises:

(a)(1) positioning a main panel on said pallet; and (a)(2) positioning a reinforcing panel on said main panel.

* * * * *